US007409740B1

(12) United States Patent
Geigan

(10) Patent No.: US 7,409,740 B1
(45) Date of Patent: Aug. 12, 2008

(54) POOL MOP

(76) Inventor: Edward Geigan, 704 Pine Creek Ct., Abingdon, MD (US) 21009

( * ) Notice: Subject to any disclaimer, the term of this patent is extended or adjusted under 35 U.S.C. 154(b) by 463 days.

(21) Appl. No.: 11/101,021

(22) Filed: Apr. 6, 2005

(51) Int. Cl.
*A47L 13/20* (2006.01)
*E04H 4/16* (2006.01)

(52) U.S. Cl. ..... 15/1.7; 15/147.1; 15/228; 15/244.1

(58) Field of Classification Search ..... 15/1.7, 15/147.1, 228, 244.1, 121
See application file for complete search history.

(56) References Cited

U.S. PATENT DOCUMENTS 1,120,780 A * 12/1914 Ziegler ..... 15/244.1
2,008,615 A * 7/1935 Rogers ..... 15/121
5,361,442 A * 11/1994 Payne et al. ..... 15/97.1
5,428,858 A * 7/1995 Vartanian ..... 15/244.1
5,461,749 A 10/1995 Ahlberg
6,047,435 A 4/2000 Suzuki
6,109,811 A 8/2000 Song

FOREIGN PATENT DOCUMENTS

EP 0 074 525 * 8/1982

* cited by examiner

*Primary Examiner*—Randall Chin

(57) ABSTRACT

An apparatus for assisting individuals in cleaning their pools. The apparatus comprises a cleaning head that is capable of being attached to a shaft or handle. The cleaning head comprises a base and a replaceable mop head that slides into the base. The replaceable mop head can only be removed from the base when from either side of the base. The base also has an attached receptacle for receiving a shaft or handle, which is removably attached to the base.

4 Claims, 3 Drawing Sheets

POOL MOP

I. BACKGROUND OF THE INVENTION

The present invention concerns that of a new and improved apparatus for assisting individuals in cleaning their pools.

II. DESCRIPTION OF THE PRIOR ART

U.S. Pat. No. 6,109,811, issued to Song, discloses a mop with a cleaning cloth for cleaning a car body or the outer wall of a building.

U.S. Pat. No. 6,047,435, issued to Suzuki, discloses cleaning cloth and device.

U.S. Pat. No. 5,461,749, issued to Ahlberg, discloses a mop for cleaning a floor having a disposable cleaning sheet and a pivotally connected handle.

III. SUMMARY OF THE INVENTION

The present invention concerns that of a new and improved apparatus for assisting individuals in cleaning their pools. The apparatus comprises a cleaning head that is capable of being attached to a shaft or handle. The cleaning head comprises a base and a replaceable mop head that slides into the base. The replaceable mop head can only be removed from the base when from either side of the base. The base also has an attached receptacle for receiving a shaft or handle, which is removably attached to the base.

There has thus been outlined, rather broadly, the more important features of a pool cleaning apparatus that the detailed description thereof that follows may be better understood and in order that the present contribution to the art may be better appreciated. There are, of course, additional features of the pool cleaning apparatus that will be described hereinafter and which will form the subject matter of the claims appended hereto.

In this respect, before explaining at least one embodiment of the pool cleaning apparatus in detail, it is to be understood that the pool cleaning apparatus is not limited in its application to the details of construction and to the arrangements of the components set forth in the following description or illustrated in the drawings. The pool cleaning apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present pool cleaning apparatus. It is important, therefore, that the claims be regarded as including such equivalent constructions insofar as they do not depart from the spirit and scope of the present invention.

It is therefore an object of the present invention to provide a pool cleaning apparatus which has all of the advantages of the prior art and none of the disadvantages.

It is another object of the present invention to provide a pool cleaning apparatus which may be easily and efficiently manufactured and marketed.

It is another object of the present invention to provide a pool cleaning apparatus which is of durable and reliable construction.

It is yet another object of the present invention to provide a pool cleaning apparatus which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
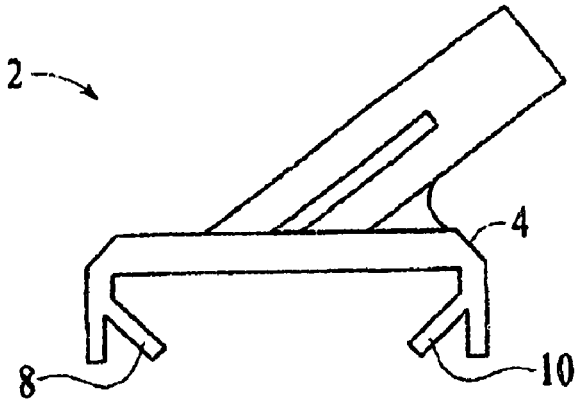
FIG. 1 shows a side view of the base before the replaceable mop head is attached to the base.

FIG. 1 shows a side view of the base 4 of the pool cleaning apparatus 2 before the mop head 6 is attached to the base 4. At the same time, FIG. 2 shows a perspective view of the base 4 and the replaceable mop head 6, while FIG. 3 shows a side view of the base 4 after the mop head 6 is attached to the base 4.

The base 4 has two ends, a first end and a second end, and furthermore, has two surfaces, a top surface and a bottom surface. As can be seen from FIG. 2, a cross-section of the base 4 shows that the outer boundaries of base 4 have a rough U-shape. Two additional prongs 8 and 10 are seen attached to the bottom surface of the base 4, with these prongs 8 and 10 being used to retain the mop head 6 once it is inserted into the base 4. The prongs 8 and 10 stretch the entire length of the base 4.

The mop head 6 has two ends, a first end and a second end, and furthermore, has two surfaces, a top surface and a bottom surface. Although the mop head 6 itself is one piece, it is best described as two separate sections that have been attached together. These two sections, which will be defined as upper section 12 and lower section 14, can easily be seen in FIGS. 2 and 3. Each of the sections 12 and 14 has two surfaces, a top surface and a bottom surface. The mop head is preferably fabricated from some type of cloth.

Figure 2:
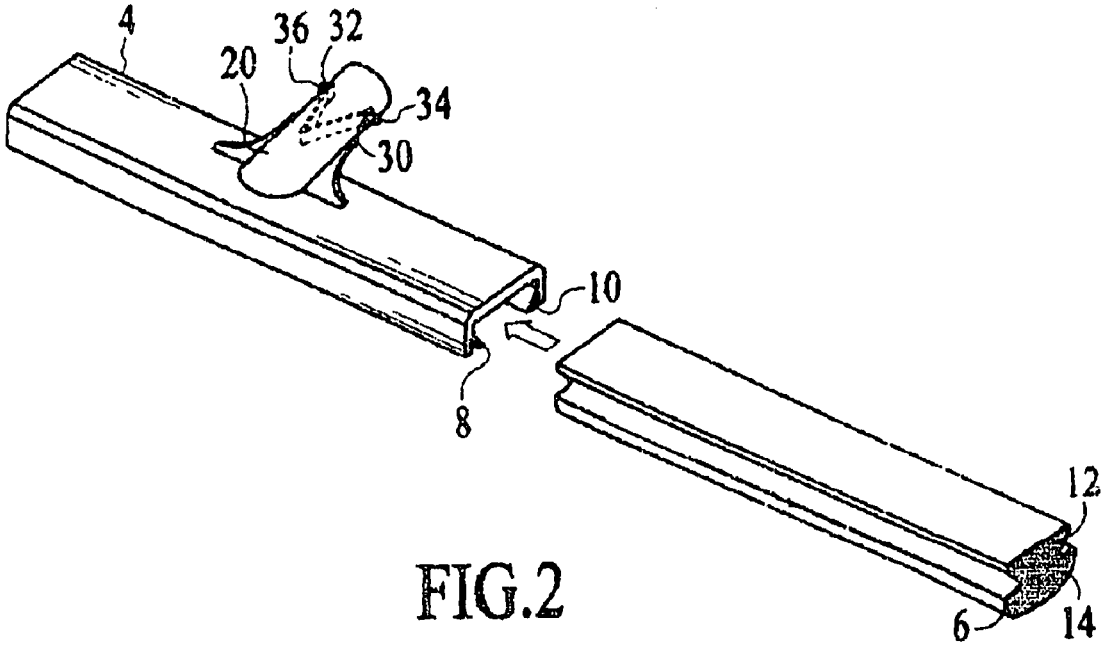
FIG. 2 shows a perspective view of the base and the replaceable mop head.
Figure 3:
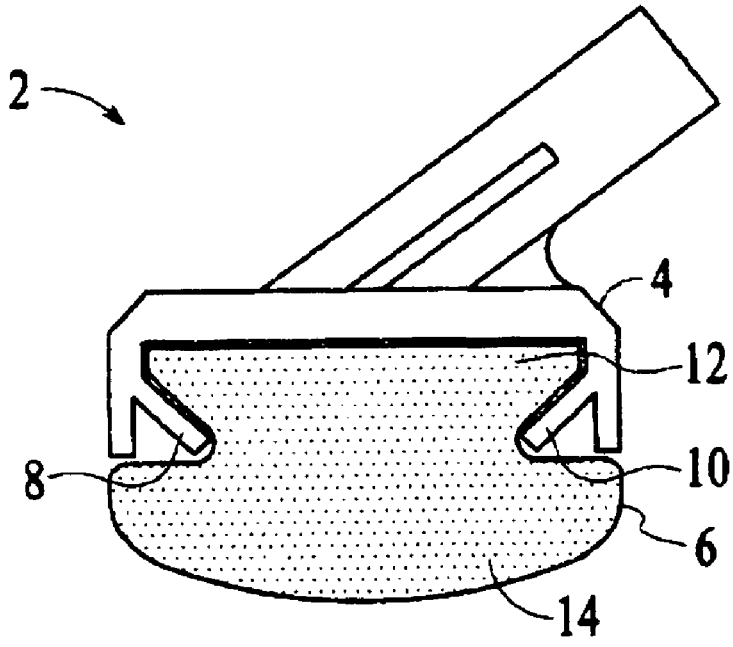
FIG. 3 shows a side view of the base after the replaceable mop head is attached to the base.

As best seen in FIG. 2 and also in FIG. 3, the upper section 12 of the mop head 6 has an upside-down triangular shape in which the width of the upper section 12 is widest at the top of the upper section 12. The upper section 12 then begins to narrow down, at which point, it attaches itself to the lower section 14. The lower section 14 can best be described as having an oval-shaped cross-section, with the bottom surface of the lower section 14 being slightly more rounded than the top surface of the lower section 14.

As seen in FIG. 2, the mop head 6 is inserted through a side of the base 4 until each of the ends of the mop head 6 are flush with the ends of the base 4. The prongs 8 and 10 are essentially flush with the side surfaces of the upper section 12 of the mop head 6. Also, essentially the entire bottom surface of the mop head 6 is exposed, thereby allowing the pool cleaning apparatus 2 to clean the surfaces of a pool.

Figure 4:
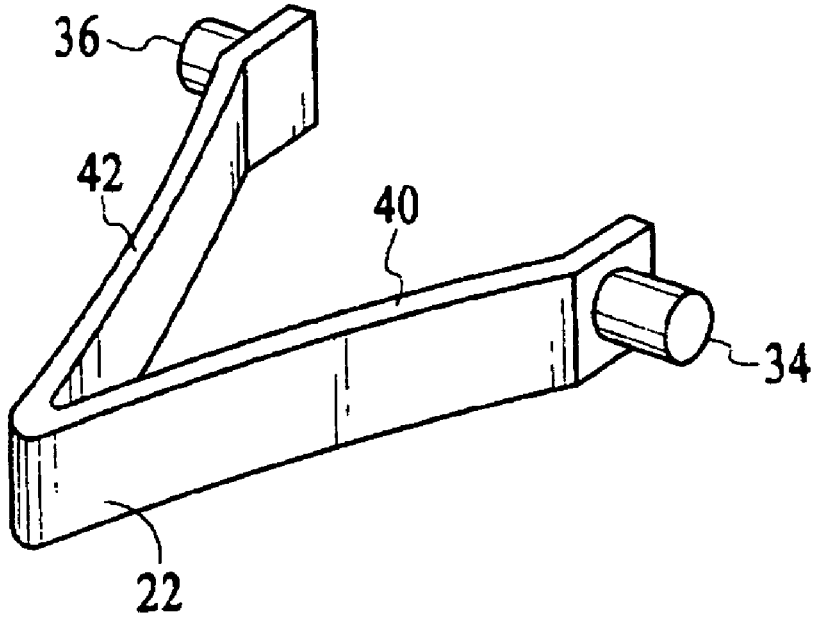
FIG. 4 shows a close-up perspective view of the tab pin.

FIG. 2 and FIG. 4 shows the attached receptacle 20 and various components within the attached receptacle 20. Tab pin 22 is shown in FIG. 4.

Attached receptacle 20 has two ends, a top end and a bottom end, and is tubular. The bottom end of the attached receptacle 20 is fixedly attached to the top surface of the base

4. The top end of the attached receptacle 20 is open. The side of the receptacle 20 has two holes 30 and 32, through which notches 34 and 36 on the tab pin 22 are inserted. Tab pin 22 has two prongs, a first prong 40 and a second prong 42, with each prong having two ends, a first end and a second end. The first end of each of the prongs 40 and 42 are connected, while the second end of each of the prongs extend outward in a V-shape. Notch 34 is attached to the second end of the first prong 40, while notch 36 is attached to the second end of the second prong 42.

The prongs are pliable, and in a default shape, the distance from the second end of the first prong to the second end of the second prong is greater than the inner diameter of the receptacle 20. By placing the tab pin 22 into the inside of the receptacle and allowing the notches 34 and 36 to be inserted through the holes 30 and 32, one can telescope the receptacle 20 into a shaft that has a pair of holes.

Figure 5:
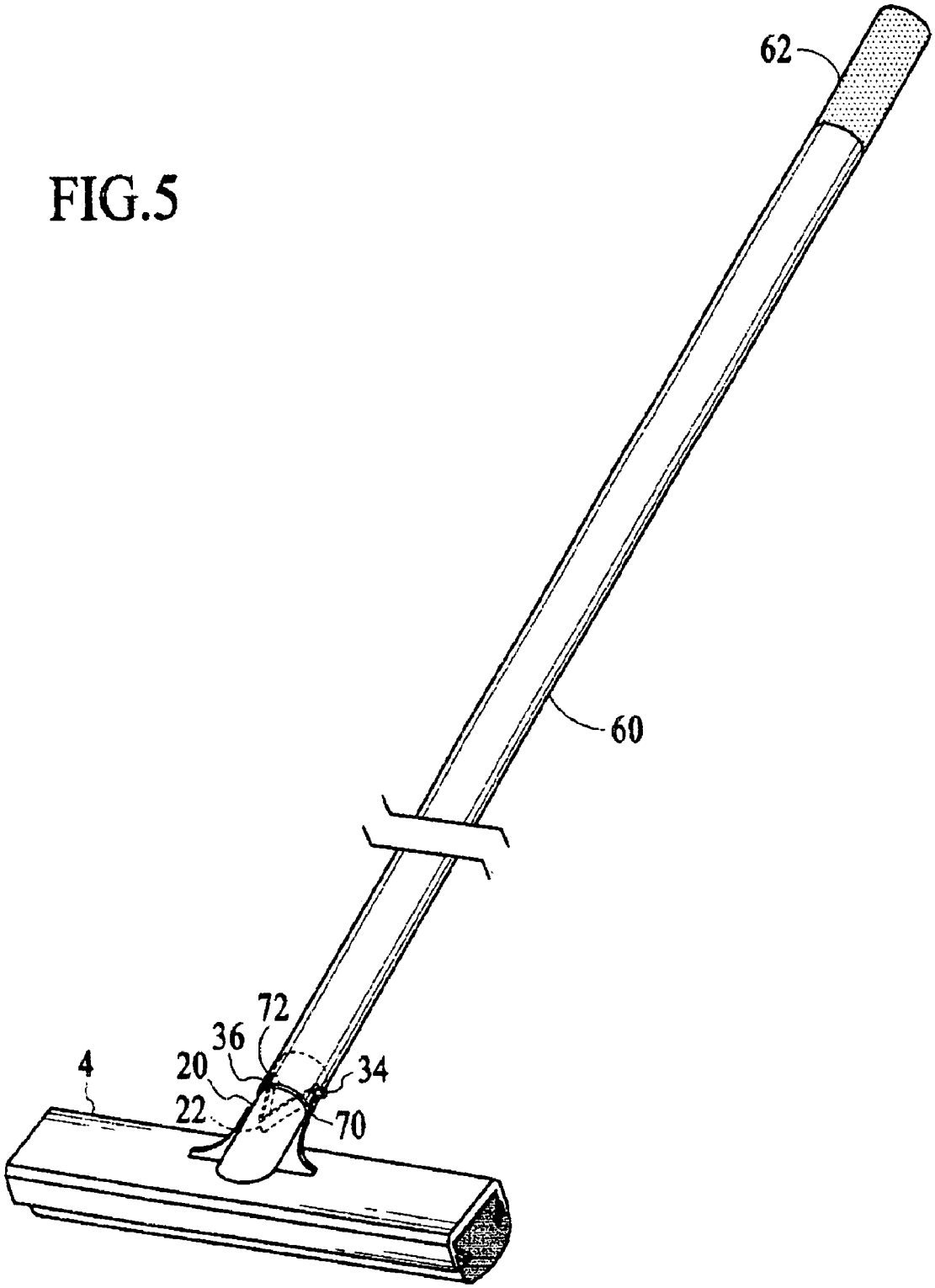
FIG. 5 shows a perspective of the pool cleaning apparatus as it would appear connected to a shaft.

FIG. 5 shows a perspective of the pool cleaning apparatus 2 as it would appear connected to a shaft 60. The shaft 60 has two ends, a first end and a second end, with the first end of the shaft 60 having a handle 62. The second end of the shaft 60 is open and has a pair of holes 70 and 72. When placed over the receptacle 20 on the base, the holes 70 and 72 have the notches 34 and 36 of the tab pin 22 inserted through, effectively temporarily connecting the shaft 60 to the base 4.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A pool cleaning apparatus comprising:

a base having a first end, a second end, a top surface, and a bottom surface, a pair of prongs attached to the bottom surface of the base, the pair of prongs comprising a first prong and a second prong, the prongs having a length equal to that of the base, a mop head having a first end, a second end, a top surface, and a bottom surface, a shaft having a first end and a second end, the second end of the shaft being open, the shaft having a pair of holes on the second end of the shaft comprising a first hole and a second hole, a handle being attached to the first end of the shaft, means for connecting the second end of the shaft to the base, the means for connecting the second end of the shaft to the base further comprising:

an attached receptacle having a top end and a bottom end, the attached receptacle being tubular, the bottom end of the attached receptacle being fixedly attached to the top surface of the base, a pair of holes located in the receptacle comprising a first hole and a second hole, a tab pin having a first prong and a second prong, each prong having a first end and a second end, the first end of each of the prongs being fixedly connected to one another, the second end of the prongs extending outward in a V-shape, a first notch attached to the second end of the first prong, a second notch attached to the second end of the second prong, wherein the tab pin is inserted into the top end of the attached receptacle so the first notch is inserted through the first hole in the attached receptacle and the second notch is inserted through the second hole in the attached receptacle, further wherein the second end of the shaft is placed over the top end of the attached receptacle until the first notch is inserted through the first hole in the second end of the shaft and the second notch is inserted through the second hole in the second end of the shaft, wherein the mop head is slidably inserted into the base.

2. A pool cleaning apparatus according to claim 1 wherein the mop head further comprises an upper section and a lower section, each section having a top surface and a bottom surface, the bottom surface of the upper section being fixedly connected to the upper surface of the lower section, the upper section having an upside-down triangular cross-sectional shape, the lower section having an oval-shaped cross-sectional shape, wherein the bottom surface of the lower section is slightly more rounded than the top surface of the lower section.

3. A pool cleaning apparatus according to claim 2 wherein the mop head has an indentation formed between the upper section and the lower section, the indentation receiving the prongs without deformation of the mop head.

4. A pool cleaning apparatus according to claim 1 wherein the mop head is fabricated from cloth.

* * * * *